US007165680B2

(12) United States Patent
Rajic et al.

(10) Patent No.: US 7,165,680 B2
(45) Date of Patent: Jan. 23, 2007

(54) SELECTIVE FLOTATION AGENT AND FLOTATION METHOD

(76) Inventors: Vladimir Rajic, Cara Lazara 101, Backi Jarak, Serbia and Montenegro (YU); Zoran Petkovic, U Tanta 5, 37000, Krusevac, Serbia and Montenegro (YU)

( * ) Notice: Subject to any disclaimer, the term of this patent is extended or adjusted under 35 U.S.C. 154(b) by 426 days.

(21) Appl. No.: 10/498,679

(22) PCT Filed: Dec. 12, 2002

(86) PCT No.: PCT/YU02/00027

§ 371 (c)(1),
(2), (4) Date: Jun. 10, 2004

(87) PCT Pub. No.: WO03/049867

PCT Pub. Date: Jun. 19, 2003

(65) Prior Publication Data

US 2005/0150330 A1 Jul. 14, 2005

(30) Foreign Application Priority Data

Dec. 12, 2001 (YU) ..... P879/01

(51) Int. Cl.
*B03D 1/10* (2006.01)
*B03D 1/01* (2006.01)
*B03D 1/012* (2006.01)

(52) U.S. Cl. ..... 209/166; 252/61; 241/20; 241/21; 241/24.13

(58) Field of Classification Search ..... 209/166, 209/167; 252/61; 241/20, 21, 24.13
See application file for complete search history.

(56) References Cited

U.S. PATENT DOCUMENTS

| | | | | |
|---|---|---|---|---|
| 4,657,669 A | | 4/1987 | Shaw et al. | 209/167 |
| 4,793,852 A | | 12/1988 | Harris et al. | |
| 4,908,125 A | * | 3/1990 | Mackenzie et al. | 209/166 |
| 5,074,993 A | | 12/1991 | Kerr et al. | 209/167 |

* cited by examiner

*Primary Examiner*—Thomas M. Lithgow
(74) *Attorney, Agent, or Firm*—Abelman, Frayne & Schwab

(57) ABSTRACT

A new reagent for the application in the preparation of mineral raw materials, mainly sulphide and oxyde mono- and polymetallic ores of non-ferrous metals, which are used as a corrosion inhibitor of the equipment and grinding bodies and as a selective collector of the wanted metal, is described. The new reagent is a composition of water, mercaptobenzothiazole salts and its derivatives in the quantity of 0–50%, by weight, sodium metasilicates in the quantity of 0.1–10%, by weight, amines in the quantity of 1–5%, by weight, and dithiophosphates in the quantity of 0.5–20%, by weight. Also, it discloses the methods for the application of that new reagent for the preparations of the copper, zinc and lead concentrates from the sulphide and oxyde ores, for the purpose of further metallurgic processing. In those methods the new reagent is added fully, or in part, in the phase of wet grinding, and in part, as needed, in the flotation phase, in the quantity of 20–300 g of the reagent per ton of ore. The application of this new reagent eliminates the need for the use of cyanide and other poisonous depressants of metals, as well as other collectors.

19 Claims, No Drawings

SELECTIVE FLOTATION AGENT AND FLOTATION METHOD

FIELD OF INVENTION

This invention relates to a new reagent used for the preparation of mineral raw materials, more specifically, the new reagent which at the same time has the function of both selective collector, and corrosion inhibitor in the preparation of sulphide and oxyde ores of non-ferrous metals, especially polymetallic copper, lead and zinc ores. The reagent, by its selectivity, eliminates the use of cyanide and other depressants in the cases in which their use has been inevitable up to now. This invention also relates to the methods of preparation of sulphide and oxyde ores of non-ferrous metals such as copper, lead and zinc, in the phases of grinding and concentration of ores by flotation process.

RELATED BACKGROUND ART

The preparation of ores for further metallurgical processing usually begins with chopping, most often grinding, to the particle size that allows successful flotation ore concentration as the second phase in its preparation. The grinding is done in mills with grinding bodies of different geometries, such as balls, rods, etc. The grinding process causes significant wear of the used grinding bodies and linings of mills which causes the increase in costs not only because of the loss of metal the grinding bodies are made of, but also the cost of transport to the location where the preparation of ore is done. Beside the grinding bodies, the linings of mills, pipelines, cyclones, flotation machines, pumps, etc., are significantly worn, too. For example, the spending of grinding bodies on the location of Veliki Krivelj of the copper mine Bor is between 700 and 800 g of steel per ton of ore.

The ball wear in wet grinding of non-ferrous metal ores is the consequence of both the corrosion and the abrasion processes. The ball wear due to corrosion is many times higher than that due to abrasion.

A significant portion of the costs of ore processing can be attributed to the consumption of grinding media and mill linings. For this reason, experiments directed at lowering steel consumption have both scientific, and practical and economic importance.

In literature, for example Hoey G. R. Can. Mining Met. Bull, vol. 68 N° 755 (1975), Balasov G. V., Tjurin N. G., Scerbakov O. K., Cvetnye metally, 11 (1978), Komlev A. M., Scerbakov O. K., Balasov G. V., Cvetnye metally, 5 (1979), it is shown that the consumption of grinding bodies and linings in mills depends on a range of factors, among which the wear of grinding media and linings due to their chemical corrosion has a great influence. Still back in 1937 did Ellis, on the basis of laboratory testing including grinding with balls of different quality, point out the significant influence of corrosion on the wear of grinding bodies. An important part of the corrosion effect in wear of grinding bodies is confirmed by industrial practice. As described by Hoey G. R. Can. Mining Met. Bull, vol. 68 N° 755 (1975), at the Wabush plant in Canada, after replacing wet grinding with dry grinding, the ball consumption was reduced from 3.15 to 1.25 kg/t. Thus Sobering and Carlson did conclude that by wet grinding, a small part of grinding media consumption was due to abrasion, while high consumption was the result of the corrosion. F. C. Bond also deems the difference in grinding media consumption between wet and dry grinding can be attributed to corrosion.

As written by Komlev A. M., Scerbakov O. K., Balasov G. V., Cvetnye metally, 5 (1979), experiments aimed at lowering the consumption of grinding bodies had been performed in the Uralmehanobr -institute by slowing down their corrosion rate. Special experiments on a rotating disc electrode indicated that steel consumption in ore pulps was mostly (50–80%) a consequence of electrochemical corrosion as oxydised layers were being permanently removed from metal surfaces.

In the course of grinding, there are certain factors which can lead to the corrosion of grinding media and linings, and they are as follows: the presence of oxygen in the pulp; the presence of oxyde, and particularly sulphide from mineral species which together with the iron metal form electrochemical pairs; chemically aggressive substances; tension in the grinding media, as well as plastic deformation and micro fractures on the surface of grinding bodies which cause differences in potentials.

The pulp pH value in the mill is one of the most important factors influencing the corrosion rate of the grinding bodies and linings. It is common knowledge that the corrosion rate suddenly increases with the decreasing pH value. It has been proved that the high-pressure surface corrodes very quickly. This point is very important for the corrosion of grinding bodies, taking into account that grinding bodies can bear high pressures at the moment of collision. Abrasion in mills also contributes to faster corrosion because oxydised layers of grinding bodies are removed more easily, leaving new and fresh metal surfaces that further corrode intensively.

The mechanism of the effect of corrosion inhibitors has not been properly studied so far. However, for most of them it was determined that they created conditions for a protective film on the metal surface, which could greatly reduce the corrosion rate.

Very efficient corrosion inhibitors in the neutral and base environment are nitrates, chromates, and silicates, as described b&y Scully J. C., The Fundamentals of Corrosion (New York), 1975. All of them have a strong affinity for metal surfaces where they form a thin protection layer which greatly reduces the corrosion rate, which was confirmed by Scully J. C., The Fundamentals of Corrosion (New York), 1975, and Martinko B., Rud. met. zbornik, 1 (1979).

The first experiments regarding the corrosion inhibitor influence on the consumption of grinding bodies in the course of wet grinding were conducted by G. R. Hoey, Can. Mining Met. Bull, vol. 68 N° 755 (1975), who achieved very interesting results. Namely, in the laboratory ball mill he carried out wet grinding experiments on copper-nickel ore with the use of various corrosion inhibitors. The results of such experiments show that the use of sodium nitrite, sodium chromate and sodium metasilicate has a great influence on lowering ball consumption in the grinding operation, ranging between 45÷50%.

By examining the influence of sodium nitrite concentration in the liquid pulp phase with pH=12.25, G. R. Hoey has found that the optimum concentration of $NaNO_2$ was within 1.0÷1.5%. He has also found that with the concentration lower than 0.5%, $NaNO_2$ had no influence at all. Optimum sodium chromate concentration with pH pulp value of 8.7÷10.1 was about 0.5%, and optimum concentration of sodium metasilicate with pulp pH value of 12.1÷12.25, was about 1%. The lowest critical concentration below which these inhibitors had no influence at all on the lowering of ball consumption was −0.3% for sodium chromate, and −0.5% for sodium metasilicate.

It should finally be mentioned that G. R. Hoey had conducted all his experiments in a lab porcelain mill, using steel balls as grinding media (0.77% C; 0.8% Mn; 0.06% Cr; 0.12% Ni).

Encouraged by the results obtained by G. R. Hoey which proved that ball consumption in wet grinding could be reduced in certain cases up to 50% by the use of corrosion inhibitors, similar studies were conducted in USSR, as written by Balasov G. V., Tjurin N. G., Scerbakov O. K., Cvetnye metally, 11 (1978). The obtained results are given in brief in Table 1.

TABLE 1

The Influence of Certain Corrosion Inhibitors on Ball Consumption in the Lab Mill

| Ground material | Liquid phase pulp composition | Loss in ball mass (g) | Consumption reduction (%) |
|---|---|---|---|
| Quartz | Distilled water | 0.736 | — |
| | Sodium nitrite (0.2%) | 0.562 | 23.6 |
| | Sodium chromate (0.1%) | 0.560 | 23.9 |
| Pyrite | Distilled water | 1.360 | — |
| | Sodium hydroxide pH = 13.18 | 0.577 | 57.6 |
| Copper-Zinc Ore | Distilled water | 1.110 | — |
| | Sodium nitrite (1.1%) | 0.592 | 46.7 |

The results shown in Table 1 reflect not only the inhibitor influence, but also the mineral content and pulp pH value on the ball consumption in wet grinding.

The use of depressants in the preparation of suliphide ores of non-ferrous metals is very common, for which cyanides, zincsulphate, sodiumsulphate, etc. are most often used as depressants. Polymetallic ores lead-zinc are the most significant source for getting these two metals. Certain natural resources have caused the ores of lead and zinc to be observed as a united ore apart from its polymetallic composition, i.e. the lead and zinc content as their economic value. Metallurgic processing of this ore sets certain conditions in terms of quality of the lead and zinc concentrates, where those concentrates are obtained in the phase of the preparation of ore for the metallurgical processing. The technical problem appearing in the preparation of these ores is the process of separating and obtaining two quality concentrates: lead and, zinc. It is customary that the collecting of ores from the flotation pulp is done by using xanthates that are very efficient at sulphide ores, if prepared in the base medium, with pH value between 7 and 9.

The fact is that today the collection of galena in the lead-zinc ore, in industrial production, is done by using a depressant for sphalerite, by what it is achieved that sphalerite, pyrite, and other sulphide materials not to be the constituent part of the galena concentrate. The most important and industrially most applied depressants practically from 1922 have been the cyanides, i.e. NaCN. Beside it, $ZnSO_4$ has been used, too, being introduced for the first time in the Sheridan-Griesvold process. Apart from these, there are other depressants, but they have not managed to eliminate the cyanides from this use because cyanides give better effect. However, since cyanides are particularly poisonous, their use is undesirable, but up to now it could not have been avoided from economic reasons. Although after being used they are collected at the bottom of a dump, there is a constant threat that they might, by diffusion through soil, get into water flows and pour out of the dump if there is damage on the barrier of the dump, what has recently happened in a damp in Romania when the river Tisa was polluted.

When the question is about the sulphide copper ores, in the preparation of the ore by flotation, xanthates, dithiophosphates, mercaptanes, thiourea, etc., are used as collectors, and all of them show good effect in flotation. However, the problem while using those collectors is that with-useful copper minerals, such as halcozym, chalcopyrite, borite, bornite and cubamite, at the same time they collect the pyrite, too, which makes the metallurgic processing of the concentrate significantly more difficult because of the increase in sulphur concentration.

Concentrating ores by lead-zinc flotation is practically done by two technological processes, which are the selective flotation of useful materials or the collective flotation of useful minerals. The process of collective flotation of lead and zinc minerals from polymetallic ores is rarely applied, and only when certain kinds of collective concentrate could be metallurgically processed later. The best known of those processes is the process known as "Imperial Smelting".

In most lead-zinc ores the process of selective flotation is applied. In that process the depressant is added in order to tip the sphalerite and the collector for collecting galena, and then the tipped sphalerite is activated by adding coppersulphate and collected by the appropriate collector. Most often used depressant for sphalerite is cyanide, and as collectors of sulphide lead and zinc minerals the xanthates, dithiophosphates, thiourea and mercaptanes are used most often.

At deposits of non-ferrous metal ores beside sulphide minerals, oxyde minerals appear, too, for example, azurite (copper oxydesulphate) malachite (copper oxyde carbonate), then in lead-zinc ores as. $ZnSO_4$, etc.

When the copper ore is in question, there is no doubt that its sulphide minerals are of the greatest economic importance and it is supposed that more than 85% of the copper production in the world originates from its sulphide ores. However, oxyde ores, too, have, and can have, a significant economic effect, or, more precisely, oxyde copper minerals, like malachite, azurite, cuprite, chryocol, brochantite, chalacnite, and other water-soluble minerals. Oxyde copper minerals flotate not as well as sulphides. The tests have proved that in one single mineral several chemical bonds are present—ionic, covalent and metallic. With the increase of the contribution of ionic bonds in a mineral, the mineral surface reacts more actively with water bipoles, so more stable and thicker layers of water are formed on the mineral surface, which makes the hydrophobisation of the mineral surface more difficult by the collector. The reason for this bad effect of the existing collectors in oxyde mineral flotation is explained by strong activity of water bipoles because of the presence of oxygen, which has great thickness and consistency of hydrate layers on mineral surfaces as a consequence. Since collector anions have large dimensions, they defund with difficulty through the thick and consistent hydrate layers, so the hydrofobisation process is made considerably more difficult. The bond between the collector anions and cations of the crystal grid f the oxyde mineral is very weak, so it is often the case that even the bonded collector is removed easily from metal surface, which altogether decreases the effect of the collector in the flotation phase. That is the reason why, for the sake of a successful flotation of oxyde copper minerals with the help of sulphide collectors, the precious partly sulphidisadion of the minerals surface is done leading to the surface compounds of sulphido-sulphate type. That additional phase which increases the overall costs is mostly done by the application of sodium sulphides, although $K_2S$, BaS and $H_2S$ are used, too. The sulphidisation result is that copper sulphide membrane improves hydrofobisation of oxyde mineral surface and facilitates the reaction of the collector with sulphidised mineral.

In order to make a difference between the up-to-now used reagents for the preparation of non-ferrous metals from the reagent according to this invention, it is important to say that in the methods of ore preparation so far, the corrosion inhibitor, if used, is added to the mills in the wet grinding phase, and depressants, collectors, foamers and other reagents to the flotation machines the flotation process is done in.

SUMMARY OF THE INVENTION

This invention provides the new reagent that is used for the preparation of mineral raw materials, especially sulphide and oxyde ores of non-ferrous metals, primarily copper, lead and zinc. The reagent according to this invention is used as the selective collector of sulphide and oxyde ores, as the inhibitor of the corrosion of the equipment and grinding bodies made of steel and iron, which are used in the phases of grinding, flotation, and other phases providing the obtaining of the concentrate of the desired metal for further metallurgical processing.

The new reagent according to this invention is a mixture of water, mercaptobenzothiazole salts and its derivatives in the amount of 35–50%, by weight, diamines in the quantity of 5–15%, by weight, and alcohol amines, such as diethanol amine and triethanole amine, in the quantity of 0.1–5%, by weight, obligatorily, and optionally of xanthates in the amount of 0.05–2%, by weight, amines in the quantity of about 2%, by weight, and dithiophosphates in the quantity of about 1%, by weight. Specific qualitative and quantitative content of components in the mixture according to this invention depends on the kind of ore and its qualitative and quantitative content, as will be clear to those skilled in the art, and as will be shown in the examples to follow as an illustration, not a restriction to the invention.

This invention also provides a new method of preparation of sulphide and oxyde ores of non-ferrous metals, the novelty of the method being that the reagent according to this invention is added to the ore, partly or in fill, in the phase of wet grinding, and partially, as needed, to the flotation phase. By using this reagent in the process according to this invention, because of the utmost selectivity of the reagent, the need for cyanide and other depressants in the concentration of lead-zinc ores ceases to exist, what not only decreases the expense, but significantly improves the environment, and while concentrating sulphide minerals of copper it is selective to pyrite, which increases the amount of copper in the concentrate and decreases quantity of sulphur by eliminating pyrite.

Also, the reagent according to this invention in particular content, depending on the kind of oxyde, is also able to collect and flotate the oxyde ores which either stand alone, or are present with sulphide ores. Finally, the application of this new method provides the saving of steel of 15–30% at grinding bodies, and the additional savings on the equipment, such as mills, flotation machines, pumps, cyclones, and alike, by preventing them from corrosion.

DETAILED DESCRIPTION OF THE INVENTION

As it has been said, the reagent according to this invention is a mixture of different substances in different quantities depending on the ore composition for the preparation of which it is used. One should bear in mind that smaller variations in the quantitative content of ores from one mine, which are usual and known to those skilled in the art, do not require qualitative and quantitative change of reagent content according to this invention.

As mercaptobenzothiazole salts and its derivatives the sodium, potassium calcium, primary and secondary amine and diamine salts were used.

The xanthates are represented by the formula used for the preparation of the reagent according to this invention

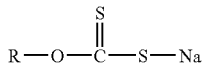

where R represents a hydrocarbon with 2–20 carbon atoms.

Diamines used for the preparation of a reagent according to this invention are given in the formula $$H_2N—R—NH_2$$

in which R represents a hydrocarbon with 2–20 carbon atoms.

The amines used for the preparation of a reagent according to this invention are represented by the following formulae:

primary

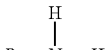

secondary

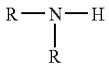

tertiary

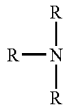

quaternary amine

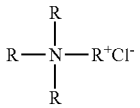

in which R represents a hydrocarbon with 2–20 carbon atoms.

And finally, dithiophosphates that are used for the preparation of a reagent according to this invention are represented by the formula

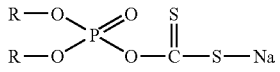

in which R represents a hydrocarbon with 2–20 carbon atoms.

A product according to this invention is prepared of the said components by simple mixing. The order of adding components is not important, but one should pay attention that the components be added to the water with the starting pH value of 14, which is achieved by adding sodiumhydroxide in the appropriate quantity for achieving that pH value to the water before any other component. Every component is ready available on the market.

Further in the text is a detailed description of equipment, ore content, reagent according to this invention, and work phases, but only for the sake of illustration of all aspects of this invention and should not be deemed limiting in any case.

Grinding experiments were carried out in the lab ball mill with sizes D×L=400×25 mm, and the number of rotations of the mill of 60 rotations per $min^{-1}$. The ball charge of the mill was 35%, and ball mass 20 kg.

Flotation experiments were performed in the lab flotation machine of DENVER type, with cell volume of 2.8 $dm^3$, and the number of rotations of 1250 $min^{-1}$.

The size distribution of the ball feed in the mill is given in Table II.

TABLE 2

Distribution of the Ball Feed in the Mill

| Size range d (mm) | Partial participation, W (%) | Cumulative participation, D (%) |
|---|---|---|
| −50 + 40 | 56 | 100 |
| −40 + 30 | 29 | 44 |
| −30 + 20 | 15 | 15 |
| | 100 | |

Chemical assays of the balls are given in Table 3.

TABLE 3

Chemical Assays of the Balls

| Sample | Ball ϕ30, mm | Ball ϕ40, mm |
|---|---|---|
| C | 1.00 | 0.94 |
| Si | 0.25 | 0.34 |
| S | 0.0017 | 0.0016 |
| P | 0.0011 | 0.0007 |
| Mn | 0.32 | 0.32 |
| Cr | 1.45 | 1.47 |
| Mo | 0.013 | 0.013 |
| Ni | 0.08 | 0.05 |
| V | 0.001 | 0.007 |
| Cu | 0.10 | 0.14 |

The chemical contents of the balls are distributed quite evenly. According to their chemical contents, we can conclude that the balls are of high quality, made of steel S. 4146.

The hardness of the balls at their cross-section is very even and according to Rockwell it is 61 HRC.

EXAMPLE 1

The experiments were carried out on a copper ore sample from the deposit at Veliki Krivelj, its chemical assay being as follows:

| Element/compound | Content, %, by weight |
|---|---|
| Cu | 0.32 |
| $Cu_{ox}$ | 0.014 |
| S | 2.15 |
| $SiO_2$ | 60.46 |
| $Al_2O_3$ | 15.66 |
| CaO | 3.65 |

-continued

| Element/compound | Content, %, by weight |
|---|---|
| $K_2O$ | 2.24 |
| Fe | 5.78 |
| $Na_2O$ | 2.86 |

The sample size at the inlet of the grinding was −3.327+0 mm. The granulometric content of the copper ore sample was as follows:

| Size class d (mm) | Partial participation W (%) | Sieve oversize R (%) | Screen undersize D (%) |
|---|---|---|---|
| −3.327 + 2.362 | 16.86 | 16.86 | 100.00 |
| −2.362 + 1.651 | 12.58 | 29.44 | 83.14 |
| −1.651 + 1.168 | 10.50 | 39.94 | 70.56 |
| −1.168 + 0.833 | 8.26 | 48.20 | 60.06 |
| −0.833 + 0.589 | 5.70 | 53.90 | 51.80 |
| −0.589 + 0.417 | 5.00 | 58.90 | 46.10 |
| −0.417 + 0.295 | 4.71 | 63.61 | 41.10 |
| −0.295 + 0.208 | 4.58 | 68.19 | 36.39 |
| −0.208 + 0.149 | 3.38 | 71.57 | 31.81 |
| −0.149 + 0.106 | 3.69 | 75.26 | 28.43 |
| −0.106 + 0.075 | 2.51 | 77.77 | 24.74 |
| −0.075 + 0.053 | 2.64 | 80.41 | 22.23 |
| −0.053 + 0.038 | 2.58 | 82.99 | 19.59 |
| −0.038 + 0.000 | 17.01 | 100.00 | 17.01 |
| | 100.00 | | |

Other physico-chemical characteristics of the sample of the said copper ore are as follows:

| | |
|---|---|
| Bond's work index, $W_i$ (kWh/t) | 15.6 |
| Thickness, ρ ($kg/m^3$) | 2629 |
| Natural pH value | 7.19 |

The conditions under which the experiments of grinding and flotation were carried out, observed through the appropriate technological parameters, were identical to those actually used in the flotation plant of the Veliki Krivelj mine. The grinding size observed through a large class participation of −0.074+0 mm ($\alpha^{-0.074}$) was about 60%. The average granulometric content of the ground sample was the following:

| Size class d (mm) | Partial participation W (%) | Sieve oversize R (%) | Screen undersize D (%) |
|---|---|---|---|
| −0.295 + 0.208 | 8.91 | 8.91 | 100.00 |
| −0.208 + 0.149 | 10.39 | 19.30 | 91.09 |
| −0.149 + 0.106 | 8.50 | 27.80 | 80.70 |
| −0.106 + 0.075 | 11.42 | 39.22 | 72.20 |
| −0.075 + 0.000 | 60.78 | 100.00 | 60.78 |
| | 100.00 | | |

Pulp thickness in grinding observed through the mass content of the solid phase in the pulp was 70%, which was appropriate to the optimum pulp thickness in the grinding process in the mentioned lab mill.

The experiments started by determining the inhibitor features of the reagent according to this invention, which was added as 1% solution to the mill, the contents of the reagent having been as follows:

| | |
|---|---|
| 1. Mercaptobenzothiazole sodium salt | 40%, by weight |
| 2. Ethylendiamine | 5%, by weight |
| 3. Triethanolamine | 0.1%, by weight |
| 4. Potassiumethylxanthate | 0.1%, by weight |
| 5. Water | residue |

The pH pulp value during the grinding and the quantity of the inhibitor-reagent according to this invention were changed several times during the testing. According to the quantity of balls consumed during such testing, the difference in the ball mass was determined before and after 20 consecutive grinding experiments with mass samples of 2 kg each. Monitoring ball consumption was conducted collectively for the whole feed, and also partially for certain ball classes. According to the class size, the consumption of balls was not different from the collective consumption for the whole feed, and therefore the collective results for the whole feed are presented.

The results achieved in the consumption of balls with and without the corrosion reagent inhibitor according to this invention in the amount of 30 g/t at different pH-values of pulp during the grinding were as follows, and they represent the average values from three successive grinding experiments:

| | Ball consumption, P (kg/t) | | |
|---|---|---|---|
| Pulp pH value 1 | without inhibitor 2 | with inhibitor 3 | $\Delta = \frac{(2)-(3)}{(2)} \times 100$ [%] Difference – saving 4 |
| 7.2 | 0.579 | 0.449 | 22.5 |
| 9.2 | 0.519 | 0.393 | 24.3 |
| 10.6 | 0.483 | 0.391 | 19.1 |
| 11.6 | 0.410 | 0.345 | 15.9 |

The achieved results regarding the reduced ball consumption were expected and logical from the point of view of the pulp pH value influence on the ball consumption in the grinding process. An interesting area of the pulp pH value for the copper mineral and similar ore flotation ranges between pH=9÷11. Testing has shown that the highest saving in the ball consumption can be achieved at pH=9.2, and the saving is 24.3%. However, it does not mean that it is an optimum pH value in the grinding process. This is because the higher the pulp pH value, the lower the ball consumption, although the effects of saving in the ball consumption decrease with use of the inhibitor-reagent according to this invention. This is the reason why the pulp pH value should be maintained at the level required by the concentration process of the copper mineral flotation.

Should it be at the level of 10.6, as it is for instance, at the Veliki Krivelj mine, then the saving in the ball consumption by the application of the reagent according to this invention lower than at pH=9.2, and is 19.1%, but the absolute ball consumption (P=0.391 kg/t) is lower than at pH at about 9.2 (P=0.393 kg/t), taking into account that, apart from the reagent according to this invention, the pulp pH value also influences the ball consumption.

The next step in the testing of the reagent according to this invention was changing the quantity of it.

The results obtained in the ball consumption, with different doses of the inhibitor according to this invention were as follows:

| Pulp | Ball consumption, P (kg/t) | | | | Difference - saving, % | | |
|---|---|---|---|---|---|---|---|
| pH | without | inhibitor dose, g/t | | | inhibitor dose, g/t | | |
| value | inhibitor | 10 | 20 | 30 | 10 | 20 | 30 |
| 9.2 | 0.519 | 0.447 | 0.429 | 0.393 | 13.9 | 17.3 | 24.3 |
| 10.6 | 0.483 | 0.426 | 0.415 | 0.391 | 11.8 | 14.1 | 19.1 |

The change of inhibitor quantity according to this invention was observed at pH=92 and pH=10.6, as interesting areas for copper mineral flotation of the Veliki Krivelj ore deposit, as well as ores similar to it. These results were logical and expected, too. By increasing the inhibitor quantity from 10 to 30 g/t, the inhibitor effect is increased, resulting in considerable decrease in ball consumption.

Based on the results shown, it can be undoubtedly concluded that the new reagent according to this invention is a very good corrosion inhibitor of grinding bodies during the wet grinding of copper ores. The effects in the decrease of grinding bodies depend on the inhibitor quantity and pH pulp value during the grinding. The final conclusion on the reagent quantity according to this invention shall follow upon the analysis of the results of copper mineral flotation by using it.

Strong inhibitor quality of the reagent according to this invention is confirmed by the relative corrosion of the balls examined in stationary conditions, in solutions of different concentrations of the inhibitor according to this invention:

| Inhibitor concentration C (g/l) | The appropriate consumption per ton of ore in grinding (g/t) | Relative corrosion speed ψ (%) |
|---|---|---|
| 0 | 0 | 100.0 |
| 0.0317 | 10 | 98.1 |
| 0.0635 | 20 | 94.7 |
| 0.0950 | 30 | 87.2 |
| 0.1270 | 40 | 76.2 |
| 0.1590 | 50 | 63.5 |

Inhibitor-reagent according to this invention, apart from its inhibitor features, has evident qualities of copper mineral collector. It does not dissolve in the grinding process, but is carried to the concentrator in its entirety, where it functions as copper mineral collector, while remaining selective to pyrite.

Potassium ethyl xanthate (PEX) is used as a collector in the quantity of 30–35 g/t for copper mineral flotation at Veliki Krivelj. In these experiments the technological scheme was simulated, as well as, other technological parameters applied at the Veliki Krivelj flotation. Copper mineral flotation experiments were carried out in four ways, namely:

Experiment 1—copper mineral flotation with individual use of PEX, in the quantity of 30 g/t added to the conditioning process.

Experiment 2—copper mineral flotation with individual use of the reagent according to this invention in the quantity of 30 g/t added to the grinding process.

Experiment 3—copper mineral flotation with the use of 20 g/t of the reagent according to this invention to the grinding and 15 g/t of PEX 10 minutes after the flotation beginning.

Experiment 4—copper mineral flotation with the use of 10 g/t of the reagent according to this invention to the grinding and 25 g/t of PEX (15 g/t) in the conditioning process, and 10 g/t 10 minutes after the flotation beginning.

The achieved technological results upon various flotation manners are given as average values obtained from three successive experiments, and are as follows:

| Experiment | Mass of the base concentrate of Cu, %, by weight | Cu content %, by weight | S content %, by weight | Cu recovery %, by weight | S recovery %, by weight |
|---|---|---|---|---|---|
| 1 | 5.77 | 4.35 | 32.96 | 78.44 | 88.38 |
| 2 | 2.38 | 9.97 | 16.85 | 74.19 | 18.65 |
| 3 | 6.41 | 4.08 | 30.05 | 81.75 | 89.60 |
| 4 | 6.80 | 3.68 | 30.66 | 78.15 | 96.96 |

The above results clearly indicate that the reagent according to this invention is a strong copper mineral collector and also very selective with respect to pyrite. Therefore, in order to achieve high copper recovery, its independent use is not recommended, but in combination with PEX in realtion of 2:1 (20 g/t reagent according to this invention +10÷15 g/t of PEX, depending upon the copper content in the ore)—Experiment 3. According to this version, with a similar quality of the collective base concentrate, 3.31% better copper recovery in the concentrate can be achieved.

The experiment 3 is particularly favourable because in the first five minutes of flotation high quality copper concentrate can be separated and directed to further cleaning without any additional grinding. This would make the process more cost-effective and the quality of copper copper concentrate much better.

The outstanding selectivity of reagent according to this invention in regard to pyrite makes the copper mineral flotation possible at lower pulp pH values which can significantly reduce the consumption of the medium regulator.

Bearing in mind that the reagent according to this invention does not dissolve in the grinding process and in its industrial application it can be used in rod mills. This reagent would reduce the consumption of steel linings, rods, and balls, and in the flotation process it could replace two thirds of potassium ethyl xanthate and provide better overall technical and financial effects.

All the above given results of experiments prove that the new reagent according to this invention is a strong corrosion inhibitor of grinding bodies (rods and balls) in mills in the course of wet copper ores grinding and a very strong copper mineral collector with almost complete selectivity to pyrite. Also, it does not dissolve in the grinding process and completely leaves for the concentrator in an active form where it serves as a very strong and selective copper mineral collector. Analysing the flotation figures and having in mind the principle that the total collector quantity is not increased (30÷35 g/t), the best effects in the flotation process can be achieved by using the reagent according to this invention and PEX in the quantity of 20+10÷15 g/t.

Although the testing was done only in ball mills, but bearing in mind that the reagent according to this invention does not dissolve in the process of grinding, the artisan would conclude that in industrial conditions it is added to rod mills. In this way we could achieve saving in the consumption of rods, steel linings and balls, and at the same time PEX is used by 20 g/t less, with better quality of the final concentrate and at least with the same recovery of a useful metal.

EXAMPLE 2

For the preparation of the copper ore of the mine Cerovo, the ore that was used had the following basic composition:

| Element/compound | Content, %, by weight |
|---|---|
| CuS | 0.29 |
| CuO | 0.30 |
| $SiO_2$ | 60.20 |
| $Al_2O_3$ | 15.39 |
| S | 2.46 |
| Fe | 3.00 |

The size in the beginning of grinding was −3,327+0 mm.

In this experiment the foamer that was used was the one under market name DOW 250, while the reagent according to this invention was used in the quantity of 50 g/t of ore in the wet grinding phase, and 200 g/t of ore in the flotation phase. The reagent used had the following content:

| | |
|---|---|
| 1. Na-mercaptobenzothiazole | 40%, by weight |
| 2. Laurilpropylenediamine | 15%, by weight |
| 3. Amylhydroxy amine | 5%, by weight |
| 4. Potassiumamylxanthate | 0.05%, by weight |
| 5. Water | Residue |

The obtained collective results are shown in the following table:

| | Mass (g) | m (%) | Cu (%) | %, by weight × Cu (%) | R Cu (%) | $\Sigma R_{Cu}$ (%) | Σ Cu (%) |
|---|---|---|---|---|---|---|---|
| $K_1$ | 8.04 | 1.02 | 17.54 | 17.9201 | 55.24 | 55.24 | 17.54 |
| $K_2$ | 6.87 | 0.87 | 5.97 | 5.1786 | 15.97 | 71.20 | 12.23 |
| $K_3$ | 36.98 | 4.67 | 5.67 | 26.47 | 16.01 | 87.21 | 16.16 |
| J | 739.90 | 93.44 | 0.016 | 11.824 | 27.20 | 100 | |
| Input | 791.84 | 100.00 | 0.44 | | | | |

EXAMPLE 3

The examinations were done on the sample of lead-zinc ore in the deposit of the mine called "Sase" by Srebrenica, Republic Bosnia-Herzegovina, the chemical composition of it being as follows:

| Element/compound | Content, %, by weight |
|---|---|
| Pb | 5.5 |
| Zn | 4.5 |
| $SiO_2$ | 60.76 |
| Fe | 6.5 |
| $Al_2O_3$ | 19.2 |

The sample size in the beginning of entering the grinding phase was −3,327+0 mm. The granulometric content of a lead-zinc ore sample was as follows:

| Size class d (mm) | Partial participation W (%) | Sieve oversize R (%) | Screen undersize D (%) |
|---|---|---|---|
| −3.327 + 2.362 | 14.18 | 14.18 | 100.00 |
| −2.362 + 1.651 | 12.34 | 26.52 | 85.82 |
| −1.651 + 1.168 | 9.66 | 36.18 | 73.48 |
| −1.168 + 0.833 | 8.03 | 44.21 | 63.82 |
| −0.833 + 0.589 | 5.39 | 49.60 | 55.79 |
| −0.589 + 0.417 | 6.65 | 56.25 | 50.40 |
| −0.417 + 0.295 | 4.00 | 60.25 | 43.75 |
| −0.295 + 0.208 | 4.02 | 64.27 | 39.75 |
| −0.208 + 0.149 | 3.66 | 67.93 | 35.73 |
| −0.149 + 0.106 | 1.90 | 69.83 | 32.07 |
| −0.106 + 0.075 | 2.63 | 72.46 | 30.17 |
| −0.075 + 0.053 | 3.33 | 75.79 | 27.54 |
| −0.053 + 0.038 | 2.47 | 78.26 | 24.21 |
| −0.038 + 0.000 | 21.74 | 100.00 | 21.74 |
| | 100.00 | | |

Other physico-chemical characteristics of the lead-zinc ore sample examined in this experiment were the following:

| | |
|---|---|
| Bond's work index, $W_i$ (kWh/t) | 15.3 |
| Thickness, ρ (kg/m$^3$) | 3094 |
| Natural pH value | 4.64 |

The examination equipment and the quality of balls are identical to the ones described just before Example 1.

The inhibitory qualities of the reagent according to this invention in the grinding phase and its collector qualities to galena, with the special view of the selectivity to sphalerite were tested. In these tests the technological scheme and the technological parameters applied in the flotation plant of the mine "Sase" were simulated.

The inhibitory qualities of the inhibitor-reagent according to this invention in the grinding phase were tested at pH=8.2, and it was found that the new inhibitor reduced the ball wear by 13%.

According to the mentioned technological scheme the experiments marked as Experiment 1 were made, in which the classical reagent system was applied with the use of sodiumcyanide and zincsulphate, as sphalerite depressant, and potassiummethylxanthate as galena collector.

The reagent according to this invention, which is applied in the experiments described herein, had the following chemical composition:

| | |
|---|---|
| 1. Sodium mercaptobenzothiazole salt | 45%, by weight |
| 2. Ethylendiamine | 10%, by weight |
| 3. Triethanolamine | 0.1%, by weight |
| 4. Water | residue |

According to somewhat altered technological scheme compared to the scheme usually applied in the Srebrenica mine, several experiments were made in which the product according to this invention was used as a galena collector. That group of experiments was marked as Experiment 2.

The quantity of the reagent according to this invention was changed from 100 to 200 g/t, with different quantities in the milling phase and the flotation phase. A higher dose enabled greater lead utilisation, while the reagent according to this invention distribution in the milling phase and the flotation phase had no significant influence on the technological indices of the flotation. The results achieved in Experiments 1 and 2 are shown in Table 4.

TABLE 4

Results of the Basic Lead and Zinc Mineral Flotation

| Exp. | Product | Mass (%) | Content Pb (%) | Recovery Pb (%) | Content Zn (%) | Recovery Zn (%) |
|---|---|---|---|---|---|---|
| 1 | $K_{1\ Pb}$ | 12.47 | 27.85 | 63.15 | 12.75 | 35.33 |
| | $K_{2\ Pb}$ | 1.48 | 13.55 | 3.66 | 10.37 | 3.42 |
| | $\Sigma K_{Pb}$ | 13.95 | 26.33 | 66.80 | 12.50 | 38.75 |
| | $K_{Zn}$ | 7.75 | 5.20 | 7.32 | 18.45 | 31.76 |
| | J | 78.30 | 1.82 | 25.87 | 1.69 | 29.48 |
| | Input | 100.00 | 5.50 | 100.00 | 4.50 | 100.00 |
| 2 | $K_{1\ Pb}$ | 14.18 | 30.10 | 77.59 | 11.50 | 36.23 |
| | $K_{2\ Pb}$ | 3.05 | 8.00 | 4.44 | 6.70 | 4.54 |
| | $\Sigma K_{Pb}$ | 17.23 | 26.19 | 82.03 | 10.65 | 40.77 |
| | $K_{1\ Zn}$ | 8.59 | 2.31 | 3.61 | 22.00 | 42.02 |
| | $K_{2\ Zn}$ | 2.54 | 2.66 | 1.23 | 3.67 | 2.07 |
| | $\Sigma K_{Zn}$ | 11.14 | 2.39 | 4.84 | 17.82 | 44.09 |
| | J | 71.64 | 1.01 | 13.13 | 0.92 | 15.14 |
| | Input | 100.00 | 5.50 | 100.00 | 4.50 | 100.00 |

In both cases, in experiments 1 and 2, coppersulphate was used as an activator and reagent according to this invention, as sphalerite collector. The results given in the above table clearly indicate that the reagent according to this invention is very selective compared to sphalerite. This fact is significant because in the lead-zinc ore flotation, where the need to add sodium cyanide and zinc sulphate as sphalerite depressant is thus eliminated, which is a very important economic, but before all environmental effect since sodium cyanide is a very strong poison. The technological parameters of the lead-zinc ore flotation achieved by applying the reagent according to this invention are significantly better than those obtained by the classical reagent regime. Compared to the classical reagent regime from the Srebrenica Concentrator, the following is achieved by using the reagent according to this invention:

- elimination of PEX as galena collector;
- same lead content in the base concentrate;
- lower zinc content in the base concentrate by 1.85%, as a consequence of the selectivity of the reagent according to this invention to sphalerite;
- higher lead recovery in the base concentrate by 15.23%;
- significantly lower lead content in the base zinc concentrate (the lead content decreases from 5.20 to 2.39%, by weight) due to better lead recovery in the lead concentrate;
- expecting better use of zinc in the zinc concentrate due to lower content of zinc in the base lead concentrate.

As Examples 1 and 2 give detailed description of both the equipment and the manner of work, i.e. The treatment of ores in the process of their application in further metallurgical processing, Examples 2–5 which follow give only the basic information on ore contents, contents and quantities of applicable reagents according to this invention, and other copper, lead and zinc ores.

EXAMPLE 4

The following basic composition ore was used for the preparation of the concentrate of lead-zinc ore of the Belo Brdo mine:

| Element/compound | Content, %, by weight |
|---|---|
| Pb (total) | 5.00 |
| Pb ox | 0.35–0.51 |
| Zn (total) | 4.00 |
| Zn ox | 0.20 |
| S | 18.00 |
| Ag (g/t) | 67.00 |

The input size of the sample was −3,327+0 mm.

The reagent according to this invention was used in the quantity of 50 g/t of the ore in the wet grinding phase and 180 g/t in the flotation phase, and it had the following composition:

| | |
|---|---|
| Potassiummercaptobenzothiazole | 35.00%, by weight |
| Butylene diamine | 5.00%, by weight |
| Triethanolamine | 0.50%, by weight |
| Sodiumbutylxanthate | 2.00%, by weight |
| Amylamine | 2.00%, by weight |
| Water | residue |

EXAMPLE 5

The ore of the same size and the following basic content was used for the preparation of the lead-zinc concentrate of the Poparic mine:

| Element/compound | Content, %, by weight |
|---|---|
| Pb (total) | 2.10 |
| Pb ox | 0.15–0.23 |
| Zn (total) | 0.55 |
| Zn ox | 0.11–0.18 |
| S | 12.50 |
| Ag (g/t) | 32.00 |

The reagent according to this invention was used in the quantity of 50 g/t of ore in the phase of wet grinding, and 120 g/t in the flotation phase, and had the following composition:

| | |
|---|---|
| Calciummercaptobenzothiazole | 45%, by weight |
| Propylen diamine | 10%, by weight |
| Dibutildithiophsphate | 1%, by weight |
| Propylhydroxy amine | 0.5%, by weight |
| Water | residue |

EXAMPLE 6

The experiment with lead-zinc ore of the mine "Sase"—Srebrenica, Republic Srpska, Bosnia-Herzegovina, which was done in the lab conditions with the ore the composition of which is provided therein, is given in Example 3 of this description. The industrial trial of the application of the reagent according to this invention in the flotation of the mine "Sase" on the pre of the following average composition is described in the following example:

| | |
|---|---|
| PbS | 4.5%, by weight |
| ZnS | 2.5%, by weight |
| $FeS_2$ | 10%, by weight |
| $SiO_2$ | 60%, by weight |
| $Al_2O_3$ | 23%, by weight |

The technological results achieved with the reagent according to this invention during the industrial trial were compared with the technological results achieved in the flotation upon the existing reagent regime in three days which directly preceded this industrial trial, at the same grinding product refinement achieved during this industrial trial, and shown in the following table:

| Size class d (mm) | Partial participation W (%, by weight) | Cumulative participation D (%) |
|---|---|---|
| +0.295 | 6.2 | 100.0 |
| −0.295 + 0.208 | 6.4 | 93.8 |
| −0.208 + 0.149 | 9.5 | 87.4 |
| −0.149 + 0.106 | 9.9 | 77.9 |
| −0.106 + 0.075 | 7.5 | 68.0 |
| −0.075 | 60.5 | 60.5 |

The average achieved technological results according to the existing reagent regime have been derived from the technological results obtained from all three shifts in three working days. Those average results are shown in the following table:

| Reagent | Dose, (g/t) | Place of adding |
|---|---|---|
| Lime | 6900 | mill with rods<br>basic zinc flotation |
| NaCN | 69 | mill with rods (55 g/t)<br>first lead clearing (24 g/t) |
| $ZnSO_4$ | 214 | mill with rods (200 g/t)<br>first lead clearing (14 g/t) |
| PEX | 73 | basic and control lead flotation |
| $CuSO_4$ | 545 | basic zinc flotation |
| PAX | 90 | basic and control zinc flotation |
| Phosphocresole | 13 | basic lead flotation |
| D-250 | 60 | basic lead flotation<br>basic zinc flotation |

The industrial trial lasted five shifts during which about 600 t of ore were processed. Organisation and stabilisation of the technological process lasted for about two shifts. The average technological results achieved relate to the three shifts of continuous work during which 380 t of ore were processed. The reagent according to this invention that was used in this industrial trial had the following qualitative and quantitative composition:

1. sodium mercaptobenzothiazole salt—43%, by weight
2. etylene diamine—10%, by weight
3. triethanol amine—0.1%, by weight
4. water-residue.

The reagent regime during this industrial trial of the application of the reagent of the above composition is given in the following table:

| Reagent | Dose, (g/t) | Place of adding |
|---|---|---|
| Lime | 6900 | mill with rods<br>basic zinc flotation |
| Reagent according to this invention | 51<br>79<br>34<br>41<br>28 | mill with rods<br>basic lead flotation<br>control lead flotation<br>basic flotation of zinc<br>control flotation of zinc |
| $CuSO_4$ | 545 | basic flotation of zinc |
| D-250 | 60 | basic flotation of lead<br>basic flotation of zinc |

The achieved technological results according to the existing classical reagent regime and upon the reagent regime of the application of the one according to this invention are in the following table:

| Product | The existing classical reagent regime | | With the use of reagent according to this invention | |
|---|---|---|---|---|
| Index | Pb (%) | Zn (%) | Pb (%) | Zn (%) |
| Inflow (I) | 4.69 | 2.44 | 3.28 | 2.17 |
| Lead concentrate ($K_{Pb}$) | 77.01 | 2.36 | 67.98 | 3.48 |
| Lead outflow ($O_{Pb}$) | 0.79 | 2.37 | 0.58 | 2.11 |
| Zinc concentrate ($K_{Zn}$) | 9.89 | 45.89 | 3.25 | 46.85 |
| Slag (S) | 0.64 | 0.76 | 0.46 | 0.77 |
| Concentrate mass (M %) | 4.87 | 3.55 | 4.06 | 2.82 |
| Metal use (U %) | 80.01 | 66.79 | 84.16 | 60.89 |

The results in the above table show that the reagent according to this invention is, before all, a very selective collector in the flotation of lead-zinc ores, and the combination of this table with the table of standard reagent regime shows that the application of reagent according to this invention considerably simplifies the reagent regime. Specifically, the need for further use of NaCN, $ZnSO_4$, PEX and PAX is eliminated. Apart from this economic effect, from the point of view of ecology, the most important fact is that the need for using NaCN as a very strong poison is eliminated. Although at this point the attention was not paid to optimisation of the quantity of reagent according to this invention, based on the industrial observations it is expected that the optimum quantity of reagent according to this invention can even be lower by 30%. Still, the very fact that the four said reagents are eliminated from use in the total quantity of 446 g/t of ore, and only one, new reagent is introduced in the quantity of 233 g/t of ore, proves the notable economic effect.

Direct comparison of achieved technological results (M % and I %) does not give the complete picture of the efficiency of the reagent according to this invention, because during its testing by this industrial probe, the content of lead and zinc in the ore was significantly lower than its content viewed in a longer period of time before, during which the classical reagent regime had been applied. This fact on the ore content has influenced some technological indices, such as concentrate mass and zinc utilisation, to become lower. However, judging by the content of lead and zinc in barren soil, for the same content at their entrance, they would be considerably better with the reagent of this invention.

The results undoubtedly point to the conclusion that with the reagent of this invention the following can be achieved:

- lead utilisation higher by 4.15%, although the lead content at the entrance is lower by 1.41% from the content found during the former period of time;
- acceptable-unpenalised zinc content in the concentration of lead of 3.48%;
- planned lead content in lead concentration of about 68%;
- higher content of zinc in zinc concentrate by 0.96%;
- considerably lower content of lead in zinc concentrate (according to the classical reagent regime there is 9.89% Pb in zinc concentrate, and with the reagent according to this invention there is 3.25% Pb); and
- almost the same content of zinc in slag (0.76%; 0.77%), with considerably lower zinc content in the ore of 0.37%.

Here it should be said that the industrial trial and the compared results of the refinement of ore grinding are from $\alpha_{0.075} \cong 60\%$, because of the lack of grinding bodies for adding to the mills. It is known that the optimum opening of the ore is at $\alpha_{0.075}$ from 65–70%. At such opening the ores shall have a considerably lower lead and zinc content in slag (size 0.3%), which was achieved in lab research.

This industrial trial provides the following conclusions:

1. the new reagent according to this invention is very selective, i.e. it is more selective than all up to now known collectors of lead and zinc minerals;

2. the use of the reagent according to this invention in the flotation of lead-zinc ore of the mine "Sase" in Srebrenica eliminates the use of four existing reagents (NaCN, $ZnSO_4$, PEX and PAX) which has enormous ecological importance, as well as the importance for wider geographical area because it eliminates the use of NaCN. Significant economic effect is achieved, too;

3. the majority of the technological indices achieved by the reagent application according to this invention are better than the technological indices achieved by the application of classical reagent regime; and 4. introduction of the reagent according to this invention and its achieving wide use in flotation is possible to do in one to two shifts, and the optimisation of dosages, at the optimum opening of the ore, in four to six working days.

In the end it is pointed out that in this industrial trial the inhibitory impact of the reagent according to this invention was not tested, because it had been done several times and proved through other experiments.

EXAMPLE 7

The industrial trial was also done with the ore of the mine Rudnik by Gornji Milanovac during which 10,000 tons of ore of the average composition was processed:

| | |
|---|---|
| Pb | 1.53%, by weight |
| Zn | 1.83%, by weight |
| Cu | 0.33%, by weight |

The refinement of milling was 78% of the size of 74 microns on the average.

Then the selective flotation was done, first of lead, then copper, and finally zinc. According to the standard flotation regime, the following reagent regime was applied on that ore:

| | |
|---|---|
| NaCN | 55 g/t |
| $CuSO_4$ | 150 g/t |
| $ZnSO_4$ | 100 g/t |
| Foamer (DOW 200) | 245 g/t |
| CaO | 1000 g/t |
| KBX (potassiumbutylxanthate) | 50 g/t |
| $FeSO_4$ | 400 g/t |

With the described ore and reagent regime, by the application of selective flotation, the concentrates of the following composition were obtained:

| | |
|---|---|
| Pb - concentrate | 72%, by weight Pb |
| Zn - concentrate | 47%, by weight Zn |
| Cu - concentrate | 20%, by weight Cu |

The reagent regime with a collector according to this invention was applied on the ore of the above composition, that regime being as follows:

| | |
|---|---|
| New collector | 55–60 g/t |
| NaCN | 38 g/t |
| $CuSO_4$ | 150 g/t |
| $ZnSO_4$ | 100 g/t |
| Foamer (DOW 200) | 245 g/t |
| CaO | 100 g/t |
| $FeSO_4$ | 400 g/t |

The new collector according to this invention that was applied in this industrial trial had the following composition:

| | |
|---|---|
| 1. Mercaptobenzothiazole sodium salt | 35%, by weight |
| 2. Mercaptobenzothiazole ethylenediamine salt | 15%, by weight |
| 3. Ethylenediamine | 5%, by weight |
| 4. Triethanolamine | 4%, by weight |
| 5. Water | 41%, by weight |

The concentrates obtained by the application of all the above-described conditions had the following compositions:

| | |
|---|---|
| Pb - concentrate | 76–80%, by weight Pb |
| Zn - concentrate | 48–49%, by weight Zn |
| Cu - concentrate | 21–23%, by weight Cu |

As can be seen from the above information, in this experiment, although the use of xanthates was eliminated and the dose of cyanide decreased by 30%, the quality of lead concentrate was increased by 4–6%, the zinc concentrate by 1–2%, and the copper concentrate by 1–3%. In the end of the experiment the consumption of steel in the mill with balls was measured, which showed the saving of 12–15%, by weight.

Based on the given examples for the preparation of zinc-lead ores by using the reagent according to this invention, it is concluded that it shows very good inhibitor qualities because it reduced the consumption of grinding bodies by 13%. What is especially important is that this new reagent is strong galena collector and at the same time very selective to sphalerite. That expressive selectivity of this new reagent compared to sphalerite eliminates the need to add sodium cyanide and zinc sulphate as a sphalerite depressant in the lead-zinc flotation, what is very important for the economy, and above all the environment, since sodium cyanide is a strong poison.

By using the reagent according to this invention all technological indices in the flotation of copper-zinc ores are significantly better than the indices obtained by classical reagent regime:

lower zinc content in the base lead concentrate by 1.85%;
higher lead recovery in the base concentrate 15.23%;
lower lead content in the base concentrate by 2.81%;
at least the same quality of the base lead concentrate; and
the need for PEX, as galena collector, is eliminated.

Based on all shown and achieved results it is concluded that the new reagent according to this invention is a good inhibitor of the corrosion of linings and grinding bodies (rods and balls) in mills at wet grinding of ores of non-ferrous metals and at the same time a very strong collector for copper and lead minerals, with high selectivity to pyrite and sphalerite.

By applying the new reagent according to this invention, the following is achieved in the copper mineral flotation:

consumption of grinding bodies lower by 15%;
lower consumption of potassiumethylxanthate by ⅔;
better quality of the final copper concentrate; and
better utilisation of copper in the concentrate, with lowering of costs for additional grinding of the concentrate and medium regulator.

By applying the new reagent according to this invention, the following is achieved in the flotation of lead-zinc ores:

consumption of grinding bodies lower by 13%;
elimination of the need for potassium ethylxanthate;
elimination of the need for sodiumcyanide and zincsulphate, which is especially important; and
the technological indices of the flotation are significantly better compared to the use of classical reagent regime.

Although during the testing the influence of this new reagent on the utilisation of non-ferrous metals, such as, for example, gold and silver, which regularly accompany the copper and copper-zinc ores had not been determined, but taking into account all characteristics of this new reagent, as well as some physico-chemical aspects of its impact as a collector, it is highly possible that it will give improved results in the utilisation of non-ferrous metals also.

All characteristics of this invention given up to now should be observed as illustrations, and not restriction, both in its composition, and in the application, which shall be obvious to those skilled in the art, because the ore compositions vary not only in a single mine, but also from mine to mine.

The invention claimed is:

1. A flotation reagent which at the same time functions as both a selective collector and corrosion inhibitor in the preparation of sulfide and oxide ores of non-ferrous metals, which comprises a mixture of water, mercaptobenzothiazole salts and their derivatives, diamines and alcohol amines.

2. The flotation reagent composition of claim 1, wherein the alcohol amines are selected from the group consisting of diethanolamine and triethanolamine.

3. The flotation reagent of claim 1 further including xanthates, amines and dithiophosphates.

4. The flotation reagent of claim 3, wherein the mercaptobenzothiazole salts and their derivatives are present in the mixture in the quantity of 35–50%, by weight, xanthate in the quantity of 0.05–2%, by weight, diamines in the quantity of 5–15%, by weight, alcohol amines in the quantity of 0.1–5%, by weight, amines in the quantity of about 2%, by weight, and dithiophosphates in the quantity of about 1%, by weight.

5. The flotation reagent of claim 1, wherein the mercaptobenzothiazole salts and their derivatives are selected from the group consisting of sodium, potassium and calcium salts.

6. The flotation reagent of claim 3, wherein the xanthates used in the collector have the formula

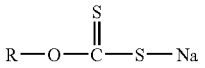

where R represents a hydrocarbon having from 2 to 20 carbon atoms.

7. The flotation reagent of claim 1, wherein the diamines used in the collector have the formula

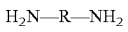

where R represents a hydrocarbon having from 2 to 20 carbon atoms.

8. The flotation reagent of claim 3, wherein the amines used in the collector are primary, secondary, tertiary and quaternary amines of the formulas

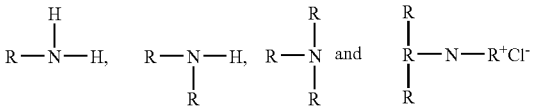

respectively, in which R represents a hydrocarbon having 2 to 20 carbon atoms.

9. The flotation reagent of claim 3, wherein the dithiophosphates used in the collector have the formula

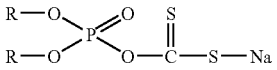

where R represents a hydrocarbon having 2 to 20 carbon atoms.

10. A method for the preparation of a concentrate of non-ferrous metals from mono- or polymetallic sulfide or oxide ores of said non-ferrous metals, which comprises the steps of wet grinding, flotation, and collecting a concentrate of the desired non-ferrous metal, said wet grinding step including adding a mixture of water, a mercaptobenzothiazole salt and its derivatives, a xanthate, a diamine, an alcohol amine, an amine and a dithiophosphate to the ore, and optionally, if needed, also during the flotation step.

11. The method according to claim 10, wherein the mercaptobenzothiazole salts and their derivatives are present in the mixture in the quantity of 35–50%, by weight, xanthate in the quantity of 0.05–2%, by weight, diamines in the quantity of 5–15%, by weight, alcohol amines in the quantity of 0.1–5%, by weight, amines in the quantity of about 2%, by weight, and dithiophosphates in the quantity of about 1%, by weight.

12. The method of claim 10, wherein the alcohol amines are selected from the group consisting of diethanolamine and triethanolamine.

13. The method of claim 11, wherein the mercaptobenzothiazole salts and their derivatives are selected from the group consisting of sodium, potassium and calcium salts.

14. The method of claim 10, wherein the xanthates used in the collector have the formula

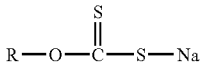

where R represents a hydrocarbon having 2 to 20 carbon atoms.

15. The method of claim 10, wherein the diamines used in the collector have the formula

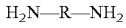

where R represents a hydrocarbon having from 2 to 20 carbon atoms.

16. The method of claim 10, wherein the amines used in the collector are primary, secondary, tertiary and quaternary amines of the formulas

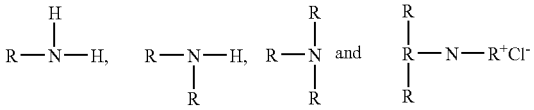

respectively, in which R represents a hydrocarbon having 2 to 20 carbon atoms.

17. The method of claim 10, wherein the dithiophosphates used in the collector have the formula

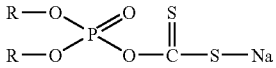

where R represents a hydrocarbon having 2 to 20 carbon atoms.

18. The method according to claim 10, wherein from 20 to 355 g of the mixture is added per ton of ore.

19. The method of claim 10 for the preparation of a copper concentrate from copper sulfide and oxide ores, wherein during the wet grinding step from 20 to 50 grams/ton of the mixture is added, and during the flotation step up to 300 grams/ton of the mixture is added, as needed.

* * * * *